United States Patent [19]

Katsumata et al.

[11] 4,050,642

[45] Sept. 27, 1977

[54] WINDING OR REWINDING FILM

[75] Inventors: Takuma Katsumata, Inazawa; Koji Kato, Aichi; Hisao Kishigami, Toki; Noriyasu Kuroda, Nagoya, all of Japan

[73] Assignee: Mitsubishi Jukogyo Kabushiki Kaisha, Tokyo, Japan

[21] Appl. No.: 620,916

[22] Filed: Oct. 8, 1975

[30] Foreign Application Priority Data

Nov. 13, 1974 Japan ..... 49-130616

[51] Int. Cl.[2] ..... B65H 75/02; B65H 23/16

[52] U.S. Cl. ..... 242/55; 242/75.3; 242/182; 226/95; 271/98

[58] Field of Search ..... 242/55, 182–185, 242/75.3; 226/95, 97; 271/183, 194–197, 211, 96–98

[56] References Cited

U.S. PATENT DOCUMENTS

| | | | |
|---|---|---|---|
| 1,575,892 | 3/1926 | Ashby | 271/98 |
| 2,678,173 | 5/1954 | Phelps | 242/75.3 |
| 3,134,527 | 5/1964 | Willis | 226/97 |
| 3,156,423 | 11/1964 | Potter et al. | 242/182 |
| 3,351,521 | 11/1967 | Murray et al. | 226/95 X |
| 3,690,644 | 9/1972 | Halbert | 271/98 |

*Primary Examiner*—Leonard D. Christian
*Attorney, Agent, or Firm*—Cushman, Darby & Cushman

[57] ABSTRACT

A method and apparatus for winding or rewinding a film wherein a pressurized jet of air is directed onto a surface of an unsupported portion of the film being wound or rewound. The air jet is elongated transversely of the length of said film. Simultaneously with the application of the air jet to the film the air impinging on the surface of the film is collected by suction.

1 Claim, 6 Drawing Figures

Figure 1A:
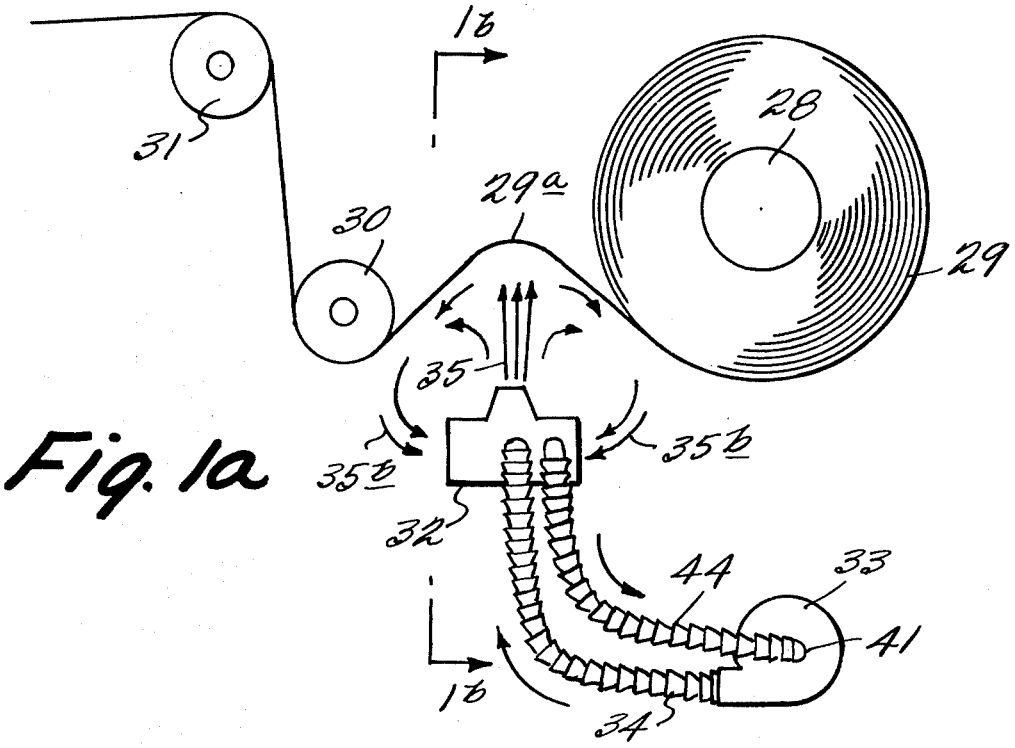

Fig. 2
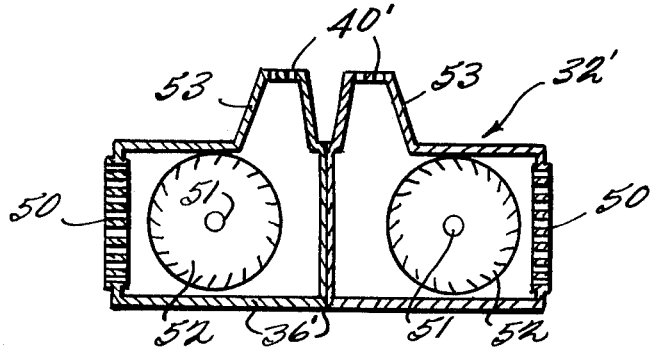
Fig. 3
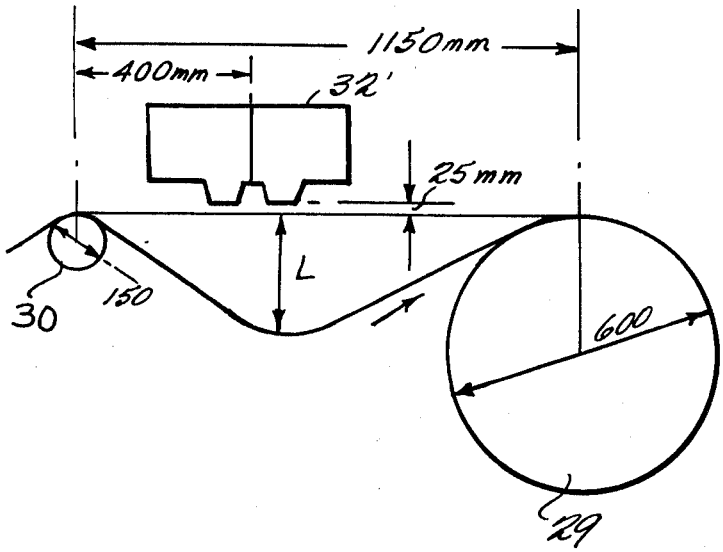
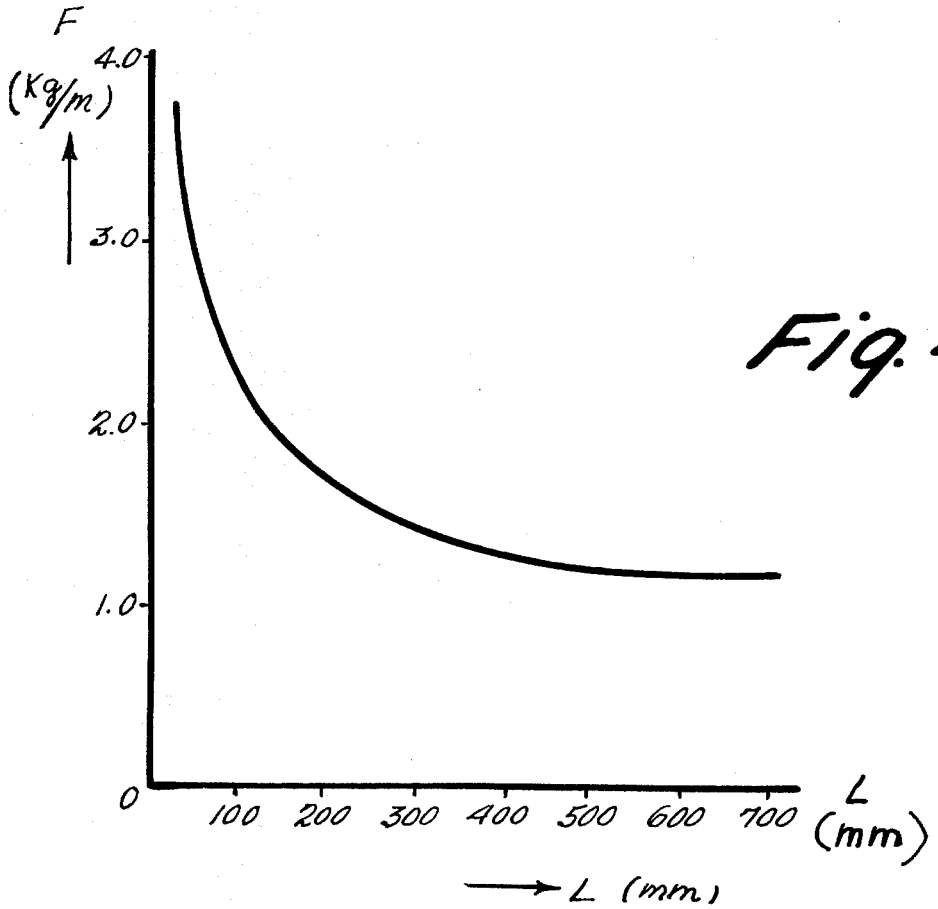
Fig. 4

WINDING OR REWINDING FILM

The present invention relates in general to improvements in winding or rewinding a film on a spool.

Heretofore, in rewinding a plastic film a dancer roll has been used for the purpose of absorbing tension variation and thereby controlling tension. Also known are winders in which a dancer roll is used for the same reason. However, dancer rolls are now not generally used in a winder except for thick sheets or narrow films because creases are apt to occur in the films and the edges of the wound films cannot be aligned. In a winder, a method of adjusting tension by controlling the torque of a motor shaft is generally employed, and in a high performance winder the tension is detected by means of a fixed roll.

As means for detecting tension exerted upon a sheet and controlling the same using a dancer roll, the tension exerted upon the sheet is detected as an electric signal derived from a displaced dancer roll actuating a potentiometer or the like. After comparing this detected signal with a preset value, a braking force is applied to a spool, as by an electromagnetic brake or a power brake, or a driving force is controlled, so as to bring the tension exerted upon the sheet to a predetermined value. This type of apparatus has a disadvantage in that the follow-up characteristic of a dancer roll, i.e., its response to film tension, is not sufficiently high.

Also known is apparatus in which current through a motor for driving a spool is detected (when the tension of a sheet being taken up becomes small, the torque of the motor is reduced and thus the current through the motor is also reduced) and thereby the tension exerted upon the sheet is detected. In order to compare the tension of the sheet with a preset value, the detected current signal is led to a current control system in which the current signal is compared with a preset current value for the motor in order to control the motor current. However, this type of appartus also involves problems in that the response characteristic for tension control is poor because of the inertia of the mechanical system, and the sheet is unevenly stretched owing to variations in tension.

Assuming that controls similar to those in the aforementioned winders are employed in a rewinder, since sound film is generally kept intact for several days for aging purposes before it is rewound by a rewinder, air wound jointly with the film escapes resulting in an eccentric deformation of the wound film. As a result, variation in tension is far larger than that which occurs upon winding, and the rewinding becomes impossible.

As described above, there are many disadvantages in the prior art methods. More particularly, in a rewinder having a dancer roll, tension of a film cannot be measured precisely because of the mass of the dancer roll, and if the r.p.m. of the spool becomes equal to or higher than the resonant frequency of the vibration system consisting or the mass of the dancer roll, the bracket supporting same and the spring for the dancer roll, not only does the capability of detecting tension diminish but also the rewinding operation per se become impossible because of the vibration of the dancer roll. As stated previously, a wound film is kept intact for several days for the purpose of aging. With regard to a material which does not necessitate aging, some idling period is necessary in view of working processes. Generally, one winder includes about 20 - 50 spools. In winding a film having a high Young's modulus it is necessary to produce spools having a small eccentricity, so in preparing spools of high precision in great numbers, a large expense is required.

A common and serious problem for both winders and rewinders is the development of creases during winding. Conventional means for preventing creases are expander rolls, cross rolls and the like, but these rolls are available only in a fixed film path and they cannot be mounted at a position between the spool and the final free roll where the film path changes during the winding or rewinding process. It is to be noted that in a plastic film machine it is important to take up a film without creases in the finally wound state. Therefore, it is desirable to remove creases before take up by suitable means in the film path. In the case of a plastic film, for the purpose of improving readiness for printing, a corona discharge treatment also is conducted in a step prior to winding by a winder. Since a film subjected to this treatment has a bad smell, the treated film is not suitable for packing goods, such as tea, whose smell is a predominant part of its commercial value. In addition, as stated previously, wound film, which for the purpose of aging is generally kept intact for several days before rewinding, is eccentrically deformed by the escape of air wound jointly with the film, and sometimes this results in eccentricity of as much as 15%. Accordingly, it is impossible to rewind such a wound film at a high speed without variation of tension and employing a dancer roll.

The present invention has been proposed in order to eliminate the aforementioned disadvantages in the prior art, and it is an object of the present invention to provide a novel method of winding or rewinding which involves no problem even if a film is taken up at a very high speed, and which achieves the desirable results of removing creases, bad smell, and the like.

According to one feature of the present invention, the aforementioned object can be achieved during the winding or rewinding process by blowing air onto a film as an elongated jet extending in a direction transversely of the length of the film while simultaneously sucking and collecting the air which has struck the film.

These and other features and objects of the invention will become more apparent by reference to the following description taken in conjunction with the accompanying drawings, wherein:

FIG. 1(*a*) is a side view of a rewinder which practices the method according to the present invention, FIG. 1(*b*) is a cross-sectional view of the same rewinder taken along line 1*b*—1*b* in FIG. 1(*a*), FIG. 1(*c*) is a cross-sectional view of an air duct provided in the same rewinder, FIG. 2 is a cross-sectional view of a preferred embodiment of an air curtain which may be substituted for the air duct in FIG. 1(*c*), FIG. 3 is a schematic view of a rewinder for measuring inflation data, and, FIG. 4 is a diagram showing the relationship between tension in a film and amount of inflation.

Now the preferred embodiments of the present invention will be described with reference to the drawings. At first, one practical example of a rewinder will be explained with reference to FIGS. 1(*a*), 1(*b*) and 1(*c*). In these figures, reference numeral 28 designates a spool on which a film 29 is taken up, and the same film 29 is paid out via guide rolls 30 and 31. Numeral 32 designates an air duct to which air is supplied from a blower 33 via a pipe 34 for blowing an elongated jet of air 35 onto the lower side of the film 29 located between the spool 28 and the guide roll 30. The jet is elongated in a direction transversely of the length of the film. Accordingly, the film 29 tends to be inflated in the lengthwise direction thereof as shown at 29*a* and simultaneously in the transverse direction thereof as shown at 29*b*. Also the air is discharged beyond the film edges as shown at 35*a*.

Details of the air duct are shown in FIG. 1(*c*). Reference numeral 36 designates an outer housing of the air duct 32, and numeral 48 designates holes provided in housing 36. Numeral 39 designates an air nozzle positioned over holes 48 and numeral 40 designates guide plates for air located on top of nozzle 39.

The interior of air duct housing 36 is divided into two chambers. Numeral 45 designates a high pressure chamber and numeral 46 designates a negative pressure chamber these chambers being separated by a partition plate 47. As stated previously, numeral 48 designates holes drilled in the wall of the high pressure chamber through which holes air is passed to the air nozzle 39. Numeral 49 designates holes drilled in the housing 36 through which holes external air is sucked into the negative pressure chamber 46 as now will be explained. Pipe 34 is connected from blower 33 to the high pressure chamber 45 of the air duct 32. The negative pressure chamber 46 is connected by pipe 44 to the air suction port 41 of the blower. As the blower operates, air is circulated through the route of blower 33 → pipe 34 → high pressure chamber 45 → holes 48 → air nozzle 39 → guide plates 40 → air flow path 35 → air flow path 35*b* → holes 49 → negative pressure chamber 46 → pipe 44 → air suction port 41 of the blower.

Figure 1B:
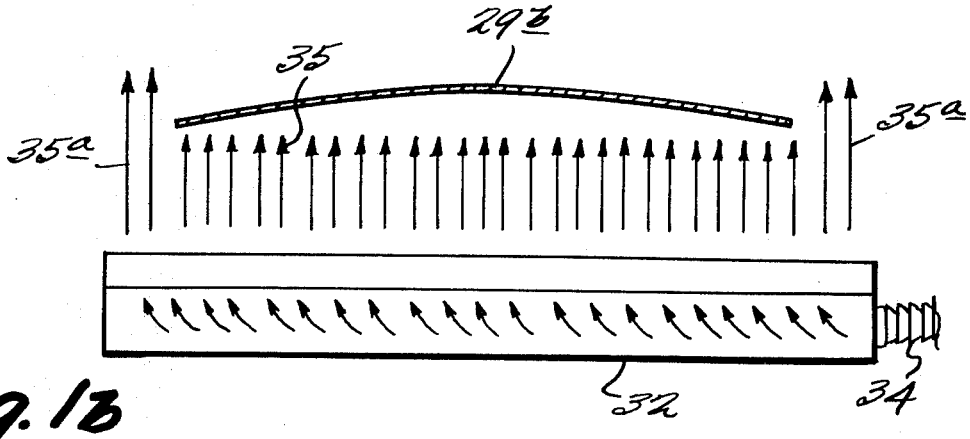

The operation of the rewinder will be described in connection to the embodiment illustrated in FIGS. 1(*a*), 1(*b*) and 1(*c*). A film 29 is wound around a spool 28, and the film is paid out from the wound film roll 29 past guide rolls 30 and 31 to the next step of the process. If the wound film roll 29 has eccentricity associated therewith, a tension change would arise for each revolution of the spool, and this tension change could not be absorbed by a control device. However, in accordance with the present invention air is sucked by blower 33 through its suction port 41 and is fed to air duct 32 through pipe 34, and the air flow 35 from the air duct 32 inflates the film in its lengthwise direction as shown at 29*a*. As a result of any tension change arising each revolution due to eccentricity of the wound film roll can be absorbed by the change of inflation of the film as illustrated at 29*a*. Additionally, as shown in FIG. 1*b*, the air flow 35 from the duct 32 also inflates the film in its transverse direction as illustrated at 29*b*, and this inflation causes tension to be exerted upon the film in the transverse direction so that creases in the film are eliminated. The air flow represented by 35*a* serves as a curtain against air beyond the width of the film. If the width of the air flow 35 were narrower than that of the film, air beyond the film width would be drawn to duct 32 which air flow could cause creases to be produced at the edge portions of the film. The air flow path represented by 35*b* is a path through which the air blown from the air duct 32 returns to the duct.

Figure 1C:
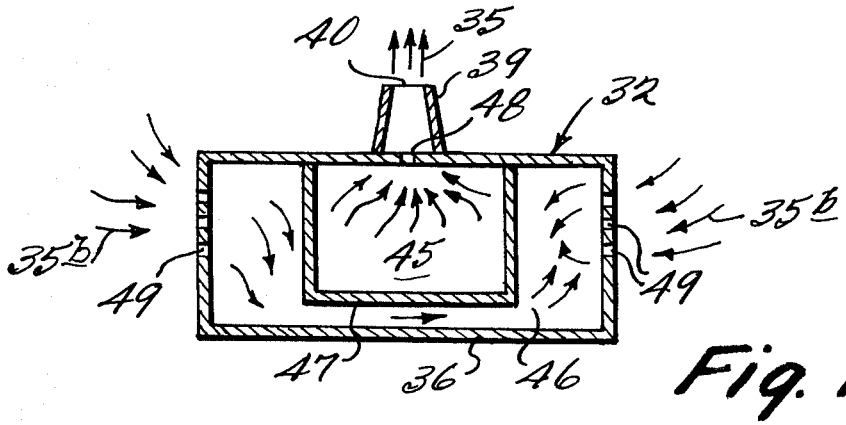

Explaining now the air duct 32 in more detail with reference to FIG. 1*c*, into the high pressure chamber 45 surrounded by a partition plate 47 air fed from the blower 33 is admitted so that a high pressure is maintained in chamber 45. The air is discharged through the holes 48. The air from the holes 48 is directed through the air nozzle 39 and the guide plates 40 against the film 29 as a directional air flow which is uniformly distributed across the width of the film. The air is then sucked into the negative pressure chamber 46 of air duct 32 through the holes 49 as shown by air flow path 35*b*. Since the negative pressure chamber 46 is maintained at a high negative pressure, the air is sucked into the air duct uniformly along the transverse direction of the film. The holes 49 are drilled on both sides of the air duct in order to prevent the film from deforming from the symmetrically inflated shape as shown at 29*a* resulting in flattening, which might be caused when the air is not sucked in symmetrically after the air flow 35 is severed into two flows upon striking the film 29. The sucked air is boosted in pressure by the blower 33, and is again fed to the high pressure chamber 45 in the air duct 32. It is to be noted that the air flow from the air duct as well as the air flow into the air duct must be uniform in the transverse direction of the film. More particularly, if the air flow striking against the film should vary in the transverse direction of the film, then the mode of inflation of the film would vary in the transverse direction causing creases to be produced, and therefore, it is very important to blow air uniformly against the film. In general, a film is apt to be electrostatically charged and is normally so charged, so that it has a disadvantage that in an environmental atmosphere where dust is drifting, the dust in the air can be adsorbed by the film resulting in its contamination. However, if a process is employed in which soon after the air is blown onto the film the air is collected, as is the case with the illustrated embodiment, then the problem of dust being caused to drift is eliminated. Consequently, the commercial value of the film is not degraded. In addition, it should be noted that the air duct illustrated in FIG. 1*c* also can be used in a winder by disposing the air duct in front of the spool.

FIG. 2 shows an alternative embodiment of the present invention in which the air duct, blower pipes and blower used in the above-described embodiment are replaced by an air curtain 32′ having a structure in which two commercially available fans for use in an air curtain are assembled in a back-to-back relationship. In this embodiment, an outer housing 36′ is divided into two chambers, each chamber being provided with an air intake port 50 and containing a flow fan 52 mounted on a shaft 51 and an air nozzle 53. In the case of the air curtain 32′ of this alternative embodiment, air is blown through the nozzles and guide plates 40′ directionally and uniformly across the transverse direction of the film, and the air curtain uniformly sucks the blown air. Since these functions of the air curtain are the same as those of the air duct of FIG. 1*c*, the air curtain can serve as a replacement for the air duct, pipes and blower of FIG. 1*c*, and if the width of the film is wider than the width of the air curtain 32′, it is only necessary to dispose a number of air curtains 32′ in alignment in the transverse direction of the film. The apparatus according to this embodiment is low in cost because commercially available mass-produced fans are employed. Also the apparatus can be made compact because pipes between a blower and an air duct are not necessitated. Furthermore, there is no need to provide a pressure difference within the housing 32′ as is the case with the above-described air duct 32, and energy loss is small since the length of the fan is substantial.

It is to be noted that in a winder or rewinder provided with the conventional tension control device as explained previously, if a further provision is made such that air is blown from the air nozzle or nozzles as shown in FIG. 1c or FIG. 2 against an unsupported film portion between the film wound around the spool and the guide roll so as to enable a wide range of tension variations to be absorbed, then excellent winding or rewinding can be achieved.

Explaining now the relationship between tension in a film and its inflation, FIG. 3 shows an outline of apparatus used when the data represented in FIG. 4 were measured. FIG. 4 is a diagram showing the relationship between film tension and the inflation of the film. The conditions under which the data in FIG. 4 was obtained employing apparatus in FIG. 3 are as follows:

film: polypropylene film subjected to biaxial stretch
film thickness: 20 $\mu$
film width: 700 mm
blower: tangential fan
blowing velocity:
average 12m/sec at a nozzle port
10m/sec at a point 300 mm from a nozzle port
7m/sec at a point 600 mm from a nozzle port
direction of film movement: as shown by the arrow in FIG. 3

In FIG. 4, the relation between an inflation L (mm) and a tension F per 1m in width (kg/m) is represented by the illustrated curve.

As full described above, the present invention is characterized in that during a film winding or rewinding process, an air flow having a cross-section elongated in the transverse direction of said film is directed against the film while the blown air is simultaneously sucked and collected. The invention eliminates disadvantages experienced in the prior art arrangements and achieves an excellent effect, as now will be described.

In a conventional rewinder, in order that a given combination of a spring and a mass of a dancer roll can respond to variation in velocity of the film being paid out, the r.p.m. of the spool is limited depending upon eccentricity of the wound film on the spool. Explaining now this limit in r.p.m. in greater detail, when the eccentricity of the wound film is large, then the variation of velocity of the film being paid out for each revolution also is large, and the dancer roll is required to move a considerable extent to absorb this large variation of velocity. This requires that the elastic constant of the selected spring be small causing the response characteristics to be degraded. Accordingly, with relatively large eccentricity, the apparatus can be operated only at a low velocity. In the above analysis, it is assumed that the mass of the dancer roll is maintained constant. Although the material, diameter, structure, etc. of the dancer roll have been investigated so as to minimize the mass of the dancer roll, reduction of the mass is limited by the bending and safety limit speed of the dancer roll. Furthermore, if the film width is increased, then the mass becomes greater in a geometrical series form.

Since the apparatus according to the present invention has the above-described structure, the aforementioned mass can be neglected. Accordingly, the variation of tension becomes small, the effect upon the next step of the process is eliminated, the rewinding velocity is greatly increased. The invention thereby contributes to improvements in production efficiency. While an expander roll or cross roll device must be employed for the purpose of removing creases of a film, such a device is presently available only in a fixed film path, and it cannot be used at a position where a film path varies such as the position just after the film has been paid out. In no industrially employed apparatus is such a device used at a postion where a film path varies. Furthermore, the expander roll must be adjusted at angles depending upon the state of the film, and also the cross rolls must be adjusted in location between the cross rolls and at angles depending upon the width and thickness of the film. In addition, in the case where an expander roll is employed, if hard dust such as fine sand has adhered onto the roll surface, scratches will appear on the film owing to friction between the film and the roll surface even though the roll surface is made of soft rubber or the like. As a result, the commercial value of the film is degraded. When cross rolls are employed, since the opposite edges of the film are engaged by means of a pair of nip rolls to eliminate creases by forcibly stretching the film in its transverse direction, the film is deformed at the engaged portions and the deformed portions therefore are slitted and scrapped since they have no commercial value. This results in degradation of the yield. According to the present invention, since forcible engagement is not applied to the film but rather the film is inflated only by the effect of forced air, creases are eliminated in the film without requiring adjustments in angles and distance. Furthermore, since no contact is made with the film, no scratches due to sand or the like are formed on the film.

Heretofore, a film subjected to a corona discharge treatment for the purpose of improving printing capability had a bad smell, and no method for eliminating this bad smell was known in the prior art. However, according to the present invention, since air is blown against the film, the bad smell at the film surface is blown away. Thus, it is possible to subject a film to a corona discharge treatment even in fields of application which have been considered unsuitable in the past, such as tea packaging, and usefulness of the film thereby is broadened.

In the case of a winder, heretofore no means has been known for eliminating tension variation caused by eccentricity of a spool, and to take up a film without tension variation improved working precision of the spool is required. Since about 20 – 50 spools are used in one winder, manufacture of spools of high precision is a large burden from an economical point of view. According to the present invention, an effect similar to the case where the Young's modulus of the film has been reduced is obtained. Tension variation does not appear due to absorption by inflation of the film. Therefore, application of a shock to the film is avoided and the shape of the wound film is improved whereby a film of good quality can be wound about a less expensive spool. In addition, according to the present invention, since an expander roll and guide rolls for removing creases are omitted, tension can be detected at a position adjacent the take-up location so that the take-up tension can be correctly controlled. With respect to an expander roll and cross rolls, since the difference in tension between the inlet and outlet of such rolls is very large in comparison to that of guide rolls, the former generally are disposed just ahead of a tension detector when precision of tension is given first preference, while they are disposed between the two guide rolls, such as shown in FIG. 1(a), when prevention of generation of creases on the film is given first preference. However, according to the present invention, creases are avoided without employing such special structure, and a plastic film wound at high precision can be easily obtained. The necessity of stretching creases is especially essential in the case of a winder, because once creases are generated, they become more significant. In order to take up a film without creases, it is most effective to dispose an expander roll or cross rolls at a position just ahead of the winding location, but they cannot be so disposed because the film path is varied by such an arrangement. Accordingly, for the purpose of taking up film without varying its path, the position where the expander roll or cross rolls are located is as described previously, and therefore, prior art apparatus had shortcomings in comparison with apparatus according to the present invention wherein it is possible to stretch film without applying substantial force thereto and without making contact therewith. Also the structure of the apparatus is very simple, and it serves as an excellent means for preventing generation of creases in the film. The present invention is very effective when applied to a winder or a rewinder of a plastic film, cellophane sheet, etc.

Since many changes can be made in the above construction and many apparently widely different embodiments of this invention can be made without departing from the scope thereof, it is intended that all matter contained in the above description or shown in the accompanying drawings shall be interpreted as illustrative and not in a limiting sense.

What is claimed is:

1. Apparatus for winding or rewinding a film comprising:

a spool;

a roll positioned adjacent said spool for guiding film being wound or rewound on the spool;

means for directing pressurized air against a surface of the film located between said spool and the guide roll and for collecting said air by suction on the same side of the film as said surface, said means including at least one nozzle formed to direct onto said film surface, and beyond the edges thereof, a jet of air which is elongated transversely of the length of said film.

* * * * *